US006343599B1

(12) United States Patent
Perrone

(10) Patent No.: US 6,343,599 B1
(45) Date of Patent: Feb. 5, 2002

(54) PAINTBALL GUN WITH PULSE VALVE FIRING MECHANISM

(76) Inventor: Aldo Perrone, 7 Blue Jay AVE, Brampton, Ontario (CA), L6T 3Z8

( * ) Notice: Subject to any disclaimer, the term of this patent is extended or adjusted under 35 U.S.C. 154(b) by 0 days.

(21) Appl. No.: 09/625,607

(22) Filed: Jul. 26, 2000

(51) Int. Cl.[7] ..... F41B 11/32; F41B 11/00; F41B 11/06

(52) U.S. Cl. ..... 124/73; 124/70; 124/75

(58) Field of Search ..... 124/73, 70, 75

(56) References Cited

U.S. PATENT DOCUMENTS

| | | | | | |
|---|---|---|---|---|---|
| 1,818,810 | A | * | 8/1931 | Miller | 124/69 |
| 3,103,212 | A | | 9/1963 | Merz | |
| 3,788,298 | A | | 1/1974 | Hale | |
| 3,965,608 | A | * | 6/1976 | Schuman | 43/110 |
| 4,936,282 | A | | 6/1990 | Dobbins et al. | |
| 5,078,118 | A | | 1/1992 | Perrone | |
| 5,333,594 | A | * | 8/1994 | Robinson | 124/73 |
| 5,349,938 | A | * | 9/1994 | Farrell | 124/73 |
| 5,349,939 | A | | 9/1994 | Perrone | |
| 5,515,838 | A | * | 5/1996 | Anderson | 124/73 |
| 5,634,456 | A | | 6/1997 | Perrone | |
| 5,727,538 | A | | 3/1998 | Ellis | |
| 5,755,213 | A | | 5/1998 | Gardner, Jr. et al. | |
| 5,878,736 | A | | 3/1999 | Lotuaco, III | |
| 5,881,707 | A | | 3/1999 | Gardner, Jr. | |
| 5,890,479 | A | | 4/1999 | Morin | |
| 5,957,119 | A | | 9/1999 | Perry et al. | |
| 5,967,133 | A | | 10/1999 | Gardner, Jr. | |
| 6,003,504 | A | | 12/1999 | Rice et al. | |
| 6,065,460 | A | * | 5/2000 | Lotuaco, III | 124/72 |
| 6,142,136 | A | * | 11/2000 | Velasco | 124/71 |

FOREIGN PATENT DOCUMENTS

| | | |
|---|---|---|
| CA | 1264128 | 1/1990 |
| CA | 2295135 | 1/1999 |

* cited by examiner

*Primary Examiner*—Charles T. Jordan
*Assistant Examiner*—John W. Zen
(74) *Attorney, Agent, or Firm*—Barry R. Lipsitz

(57) ABSTRACT

A gas operated paintball gun includes a barrel, a breech connected to a rear end of the barrel, a movable trigger, a bolt movable in the breech and a hammer connected to the bolt and mounted for sliding movement in a chamber. A pneumatic circuit in the gun operates the hammer and includes a pulse valve, a trigger-activated switch mechanism for operating the pulse valve and a gas regulator for supplying gas to the pulse valve. A further valve mounted in the gun is opened by engagement by the hammer and, when open, releases pressurized gas into the barrel to propel the paintball. The pulse of gas created by the pulse valve is delivered to the hammer chamber and acts to drive the hammer to its firing position.

20 Claims, 3 Drawing Sheets

PAINTBALL GUN WITH PULSE VALVE FIRING MECHANISM

BACKGROUND OF THE INVENTION

This invention relates to gas operated guns and, in particular, guns capable of firing a projectile, such as a paintball, using pressurized gas.

Guns operated by means of a supply of pressurized gas have been known for quite some time and these guns have been used to fire a variety of projectiles including pellets and small balls. In more recent years, gas operated guns designed specifically to fire paintballs have been developed. The paintballs may comprise a mixture of a liquid including ethylene glycol with the liquid being encased in a fragile gelatin casing and these paintballs are designed to break apart upon striking a target in order to mark same. Paintball guns are now in widespread use for purposes of target practice and mock war games.

A variety of systems and mechanisms are known for operating a paintball gun by means of a trigger. In the semi-automatic gun shown and described in applicant's U.S. Pat. No. 5,349,939 which issued Sep. 27, 1994, there is a hammer mechanism slidably mounted in the gun, this hammer being biased towards a forwards firing position by a coil spring. There is a sear device mounted on a sear pin and this device is operated by a pivoting trigger. A sear spring biases the sear device so that the front end thereof pivots downwardly after the hammer is released. A small sear detent is slidably mounted in the front end of the sear device and is biased forwardly by a spring. This firing mechanism is relatively complex and requires some skill on the part of the gun assembler to make the gun.

Recently, electronically operated paintball guns have come into use, one such gun being illustrated and described in U.S. Pat. No. 5,967,133 issued Oct. 19, 1999 to Smart Parts Inc. This gun includes three main components, a body which houses all of the pneumatic components and electrical power source, a grip mounted to the body and housing an electrical switch able to activate a launching sequence, and an electrical control unit which directs flow between the pneumatic components. The electrical control unit includes an electrical timing circuit that is activated when an electrical switch is closed. There are two electrically operated valves which are sequentially energized by the timing circuit to enable the loading of a projectile and the release of compressed gas from a storage chamber. Difficulties with guns of this general type include the need for at least one battery that is mounted in the gun and the need for a control circuit and wiring, which can add to the expense of the gun.

It is an object of the present invention to provide a gas operated gun that is relatively inexpensive to manufacture and quite reliable and which does not require the use of a sear mechanism.

It is a further object of the present invention to provide a gas operated gun capable of filing projectiles such as paintballs that employs a relatively simple trigger activated switch mechanism and a so-called pulse valve capable of delivering a pulse of gas to a chamber in the gun in order to drive a hammer to its firing position.

SUMMARY OF THE INVENTION

According to one aspect of the invention, a paintball gun includes a gun body, a barrel mounted on the gun body, a trigger movably mounted on the gun body, and a hammer slidably mounted in a chamber formed in this gun body, the hammer being movable between a retracted position and a forward position. The gun includes a first pressurized gas circuit for delivering pressurized propellant gas from a supply to the barrel for propelling paintballs therefrom. This first circuit includes a first valve. The gun further includes a second pressurized gas circuit connectible to a gas supply to receive gas therefrom, this circuit including a pulse valve having a gas inlet and a gas outlet and a trigger-activated switch valve capable of operating the pulse valve and having a valve outlet operably connected to the gas inlet of the pulse valve. The pulse valve is adapted to provide a pulse of pressurized propellant gas at the gas outlet when the trigger is pulled and this gas outlet is operably connected to the chamber for the hammer. During use of the gun, the pulse of propellant gas is capable of driving the hammer to its forward position at which it strikes the first valve to open it and release pressurized propellant gas into the barrel in order to propel a paintball therefrom.

Preferably the gun includes a bolt slidably mounted in a breech of the gun from a retracted position where a paintball can enter the breech to a forward firing position and the hammer is connected to the bolt for movement therewith.

According to a further aspect of the invention, there is provided a gas powered gun for firing balls, this gun being adapted for connection to a source of pressurized gas and having trigger-activated valving for controlling the flow of pressurized gas within the gun. The gun includes a barrel and a breech at a rear end of the barrel for receiving one ball at a time through a ball feed port. A hammer is slidably mounted in a chamber formed in the gun and biased to a retracted, non-firing position. A bolt is slidable within the breech to advance the ball to a firing position and close off the feed port. A first pressurized gas delivery system provides pressurized gas from the source to the barrel for propelling the ball therefrom. This first system includes a gas releasing valve which is opened by the hammer being driven to a firing position. A second pressurized gas delivery system provides a pulse of pressurized gas from the source to the chamber in order to drive the hammer to the firing position. The second pressurized gas system includes a pulse valve which is operated by the trigger activated valving.

According to a further aspect of the invention, a gas operated gun operable to fire projectiles includes a gun body having a gun handle, a barrel mounted on the gun body and a breech connected to a rear end of the barrel. There are a movable trigger mounted on the gun body and a bolt movable in the breech between a rearward position where a projectile can enter the breech through an inlet and a forward firing position. A hammer is connected to the bolt and is mounted for sliding movement in a chamber formed in the gun body between a rearward position and a firing position. A spring is mounted in the gun and biases both the bolt and the hammer towards their rearward positions. A unique aspect of this gun is its pneumatic circuit for operating the hammer, this circuit including a pulse valve and a trigger-activated switch mechanism for operating the pulse valve. The circuit further includes a gas regulator for supplying gas at a predetermined pressure to the pulse valve. The pulse valve has a valve outlet for a pulse of pressurized gas which can be produced by it when the trigger is pulled. This valve outlet is connected by a passage to the chamber for the hammer. A further valve is mounted in the gun body and is adapted to be opened by engagement by the hammer when the hammer moves to the firing position. Opening of this valve permits passage of pressurized gas from a pressurized gas source into the barrel to propel the projectile along and out of the barrel.

Preferably the spring is a coil spring mounted in the breech and engaging the bolt and the switch mechanism is a two-position switch valve mounted in the gun body adjacent the trigger. An outlet of the gas regulator is connected by a gas line to an inlet of the switch valve and an outlet of the switch valve is connected by a further gas line to an inlet of the pulse valve.

Further features and advantages will become apparent from the following detailed description taken in conjunction with the accompanying drawings.

DETAILED DESCRIPTION OF PREFERRED EMBODIMENT

Figure 1:
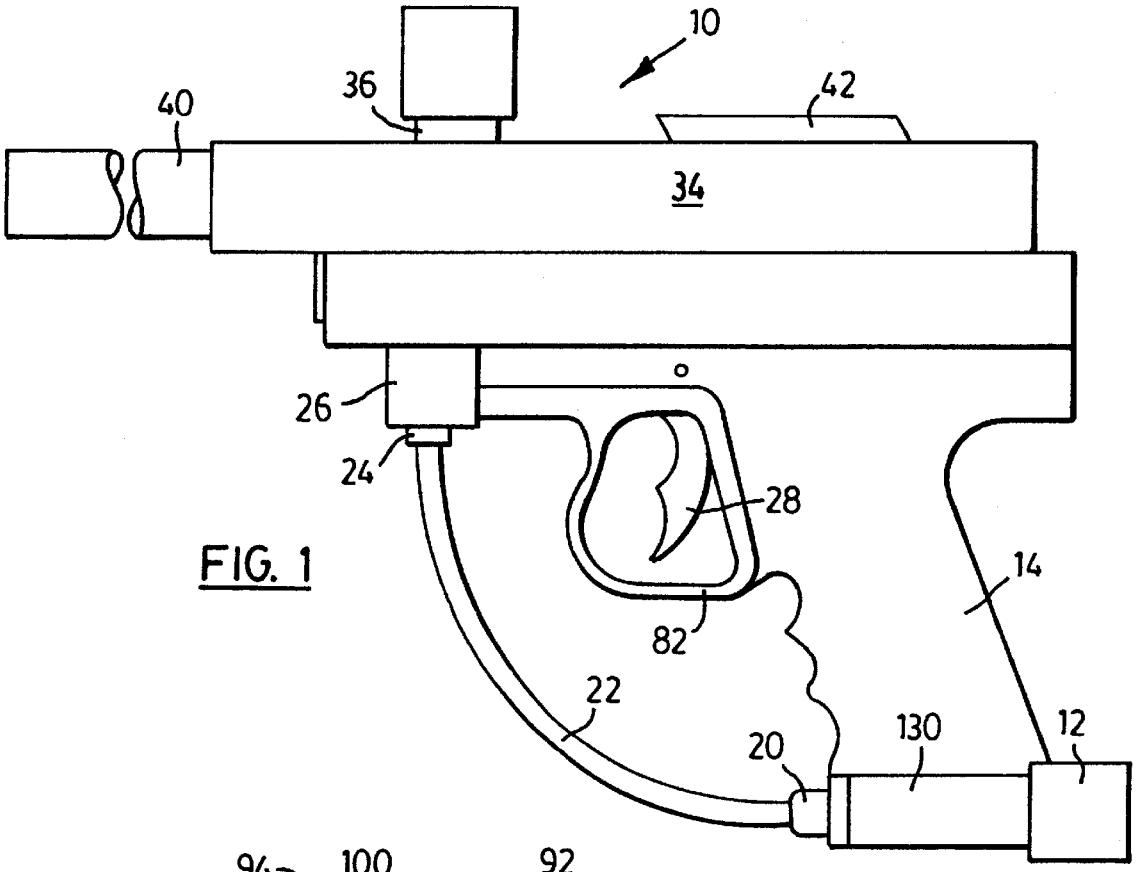
FIG. 1 is a side elevation of a paintball gun constructed in accordance with the invention, the gun being shown without a pressurized gas container being attached thereto.
Figure 4:
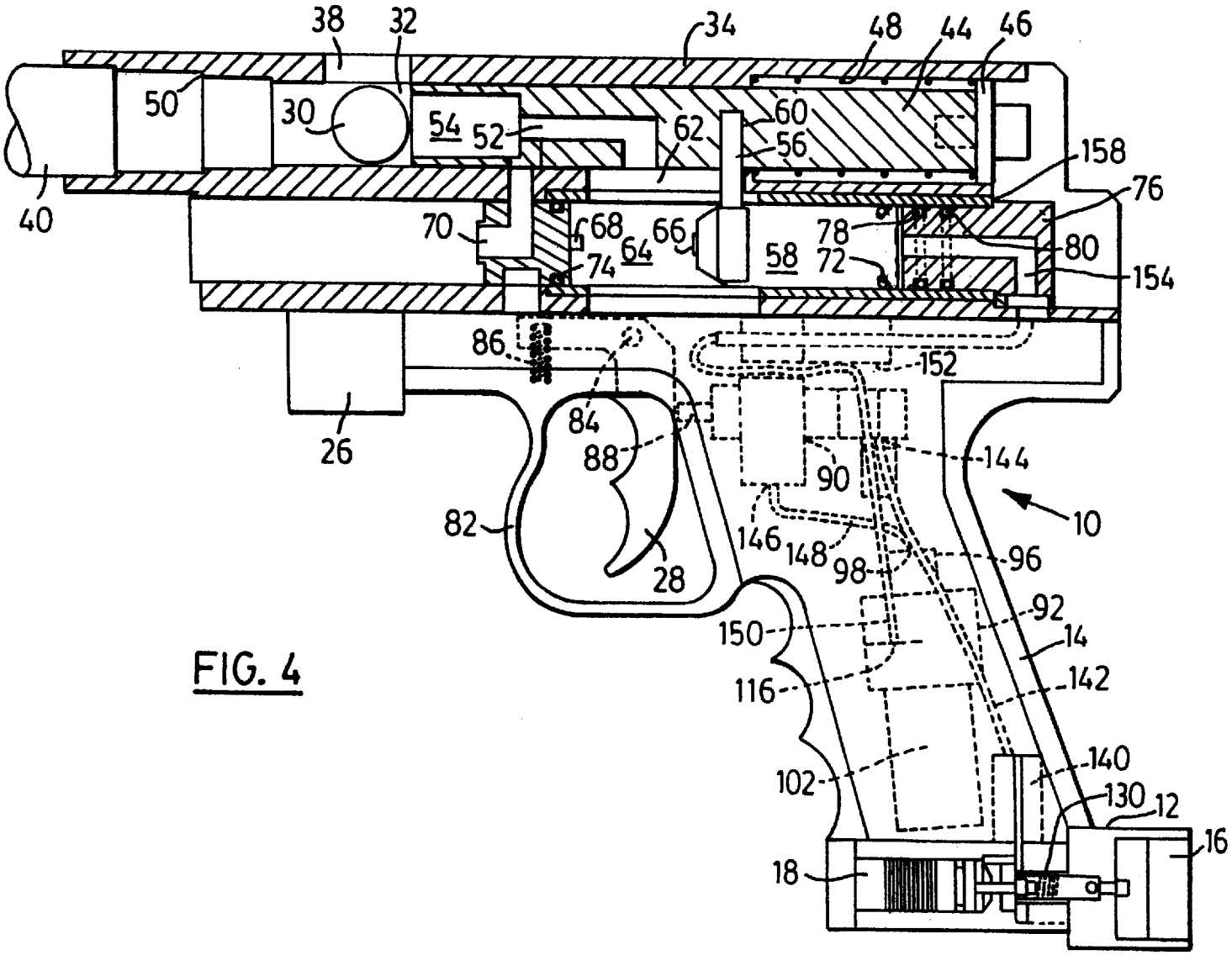
FIG. 4 is an elevational view of the main body of the gun of FIG. 1, including the trigger, handle and breech portion with the breech portion and a hammer containing chamber being shown in cross-section for purposes of illustration.

A preferred embodiment of a paintball gun 10 constructed in accordance with the invention is shown in FIGS. 1 and 4, with the view of FIG. 4 being on a larger scale. It will be understood that this gun employs a standard pressurized gas cylinder (ie. a $CO_2$ cylinder) which is not shown but which is attached by means of a standard connector housing 12 which can be connected to a bottom end of the gun's grip 14. The housing can be internally threaded (not shown) in receiving cavity 16 so that the $CO_2$ cylinder can be attached by the threads. The front end of the housing 12 is provided with an internally threaded bore 18. Threaded into this bore can be a gas line connector 20 which itself is connected to one end of a short length of flexible metal pressurized gas hose 22 capable of carrying a relatively high pressure gas, typically in the range of 750 psi. The connector 20 can be a standard brass fitting as can the connector 24 at the opposite end of the hose. The connector 24 is attached to a first, high pressure valve 26 which can be of standard construction (accordingly a detailed description of this valve is deemed unnecessary). The valve 26 is mounted to the main body of the gun a short distance in front of trigger 28.

The gun 10 is adapted to fire paintballs 30, one of which is illustrated in a chamber 32 located in the breech 34 of the gun. The paintballs are fed one at a time through a paintball feed tube 36 which can be connected to a bulk loader (not shown). The illustrated gun has a ball feed port 38 located in the top of the breech and the feed tube is connected to the breech at this point. The paintballs are of well known construction and can be of standard size. They will readily break upon impact with the target and generally are intended to leave a distinctive mark on the target. The gun 10 includes a barrel 40 which can vary in length and which is attached at its rear end to the breech 34. Also, the illustrated gun has a sight protector 42 arranged on top of the breech. In a known manner, slidably mounted within the breech is a bolt 44 which is elongate and generally cylindrical. The preferred illustrated bolt has a rear end flange 46 which is engaged by a coil spring 48 that extends about the bolt and that biases the bolt towards its rearward position. It will be understood that the bolt is movable in the breech between the rearward position shown in FIG. 4 where a projectile such as paintball 30 can enter the breech through the port or inlet 38 and a forward firing position. This forward firing position has the extreme forward end of the bolt approximately in line with the annular shoulder indicated at 50 in FIG. 4. It will be appreciated that in this firing position, the bolt advances the paintball to the firing position and closes off the feed port 38 so that propellant gas cannot escape through the port when the gun is fired. The illustrated bolt also has a L-shaped gas passageway 52 at the front end of which is a large central cavity 54. A straight-rigid metal pin 56 extends downwardly from the bolt to a hammer 58. The pin 56 can be made of steel and is preferably force fitted into a hole 60 formed in the bottom of the bolt. The pin extends through an elongate slot 62 and into a cylindrical hole formed in the forward end of the hammer.

The hammer 58 is mounted for sliding movement in a generally cylindrical chamber 64, this chamber being formed in the gun body or the main portion of the gun. The hammer can slide from a rearward or non-firing position which is that shown in FIG. 4 to a firing position where its front end at 66 strikes a gas releasing pin 68 for actuating the first valve 26. The striking of the hammer against this pin causes the first valve to release relatively high pressure gas through L-shaped passageway 70. This high pressure gas enters the barrel through the passageway 52 since the rear end of this passageway 52 will then be aligned with the top end of passageway 70. In order to prevent the repellant gas from passing through the rear end of the chamber 64, the rear end of the hammer 58 is fitted with an O-ring seal 72. A further O-ring seal 74 can be mounted on the first valve structure and located at the front end of the chamber 64. Two further O-ring seals can be provided in a rear end section 76 of the gun, these seals being located at 78 and 80. It will be understood that principal components of the gun, including the breech and rear end portion 76, can be made of a suitable metal or a strong, rigid plastics material such as fiberglass filled nylon.

Pivotally mounted in the main body of the gun or the gun frame is the trigger 28 which can be protected by a trigger guard 82. The illustrated trigger pivots about a pivot pin 84 and the trigger is biased towards a forward position by a small coil spring 86 which engages a forward arm of the trigger. Rearward movement of the trigger operates a movable pin or button 88 which is part of a switch mechanism, preferably a switch valve 90. The switch valve 90 operates a main component of the pneumatic circuit of the gun, namely a pulse valve 92. It will be understood that the switch valve 90 has two positions, namely an open position which allows pressurized gas to flow through this valve and a closed position which cuts off all gas flow. The switch valve is a standard valve for various pneumatically operated devices and accordingly a detailed description herein is deemed unnecessary.

Figure 2:
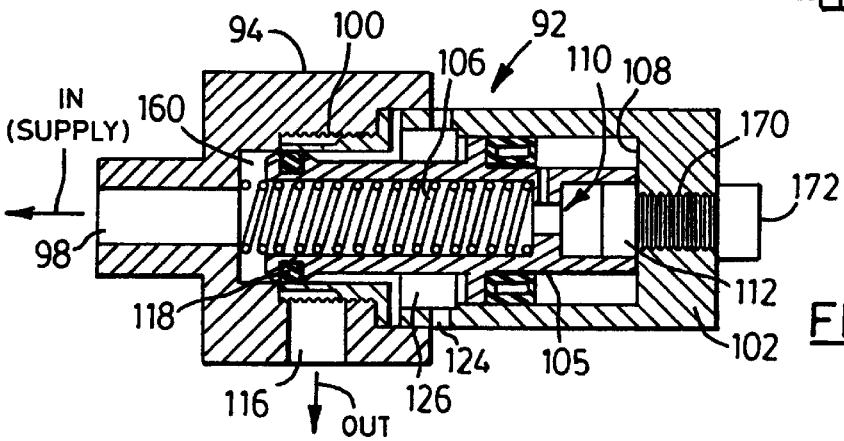
FIG. 2 is an axial cross-section of a pulse valve that can be used in the gun of FIG. 1, this valve being shown in its unshifted position.
Figure 3:
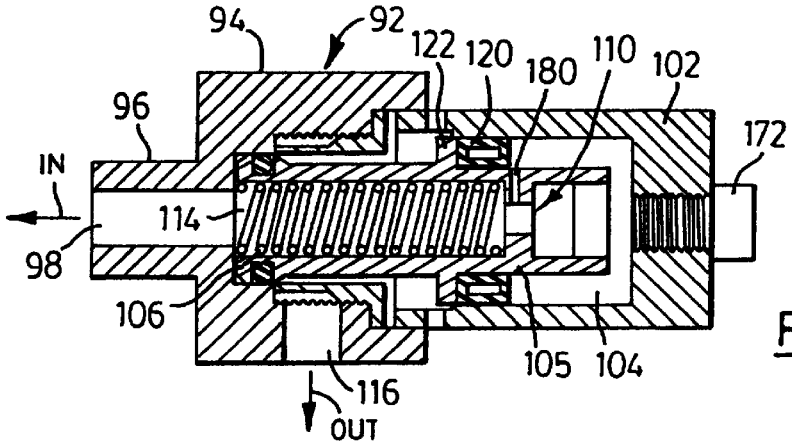
FIG. 3 is an axial cross-section similar to FIG. 2 but showing the pulse valve in its shifted position.

The construction of a preferred form of pulse valve is illustrated in FIGS. 2 and 3 of the drawings. One suitable form of pulse valve is Model PV-1 sold by Clippard Minimatic (Trademark) Valves, a U.S. valve manufacturer. However, this known valve is modified by reducing the size of the small orifice therein in order to reduce the length of the usual pulse to approximately 8 milliseconds for a currently preferred version of the gun. This compares to a pulse of approximately 100 milliseconds in the standard version of this particular valve. The valve includes a cylindrical base portion 94 having an inlet extension 96, which can be externally threaded, and a central passageway 98. The passageway opens into a central, threaded cavity 100 and mounted in this cavity is one end of a cylindrical valve body 102. The valve body forms a cylindrical valve chamber 104, this valve chamber extending into the cavity in base portion 94. A piston member 105 is slidably mounted in the chamber and is movable back and forth between the two positions shown in FIGS. 2 and 3 of the drawings, with FIG. 2 showing the valve in the unshifted position and FIG. 3 showing the valve in its shifted position. A valve spring 106 is mounted inside a central passageway of the piston member and acts to bias the piston member towards an end 108 of the valve chamber. Also mounted in the piston member is a check valve 110 located in an internal transverse wall, against which one end of the spring 106 engages. It will be understood that the check valve 110 only allows flow of pressurized gas in one direction, that is towards and into an end cavity 112. The check valve only opens when a predetermined level of gas pressure is achieved in the central passageway 114. The central passageway 98 forms an inlet into the chamber of the pulse valve while there is an outlet from the chamber through passageway 116. Other features of the illustrated pulse valve include an O-ring seal at 118 mounted at the inlet end of the piston member and a further annular seal 120 mounted on the circumference of the piston member adjacent a circumferential flange 122. It will also be noted that there are one or more exhaust ports 124 formed in the cylindrical wall of the valve body 102 so that annular chamber 126 is vented to atmosphere.

The line connections between the regulator for the gun, this regulator being located at 130, the switch valve 90 and the pulse valve will now be described with reference to FIG. 4. In addition to the outlet at 18, the regulator has a second outlet 140 which is connected by a pressurized gas line 142 to an inlet 144 of the switch valve 90. The switch valve has an outlet at 146 which is connected by a short pressurized gas line 148 to the inlet passageway 98 of the pulse valve. Also shown in FIG. 4 is a further pressurized gas line 150 which is connected to the outlet 116 of the pulse valve. This line extends through a support member 152 formed in the gun body and its outlet end is operatively connected to a L-shaped gas passageway 154. The passageway is formed in the rear end section 76 which closes the rear end of a metal tube 158 in which slides the hammer 58. Thus, the pulse of pressurized gas from the pulse valve is able to flow through the gas line 150, the passageway 154 and into the space between the rear end of the hammer and the front end of the section 76, causing the hammer to be driven forward to its firing position.

Figure 5:
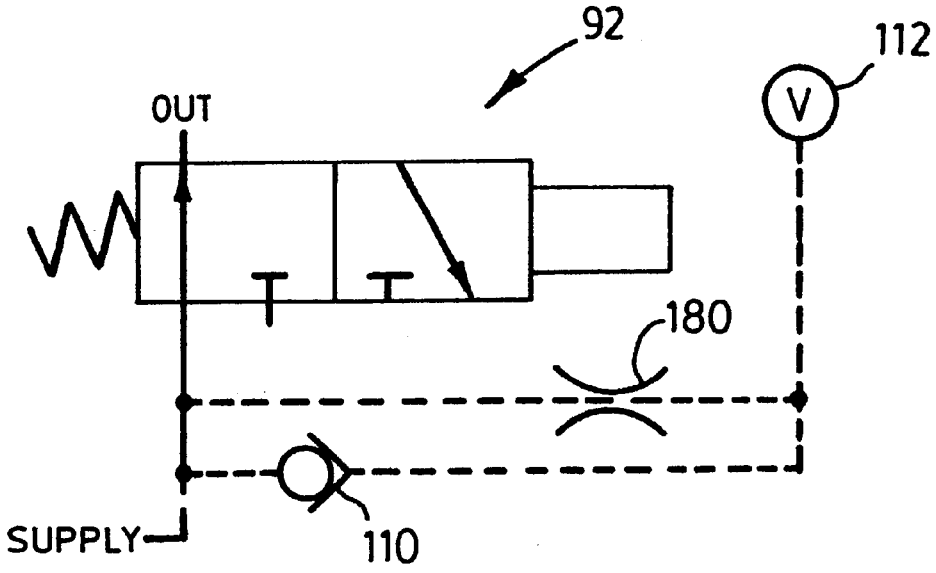
FIG. 5 is a schematic illustration using ANSI symbols illustrating the operation of the pulse valve of FIGS. 2 and 3 in its unshifted position.
Figure 6:
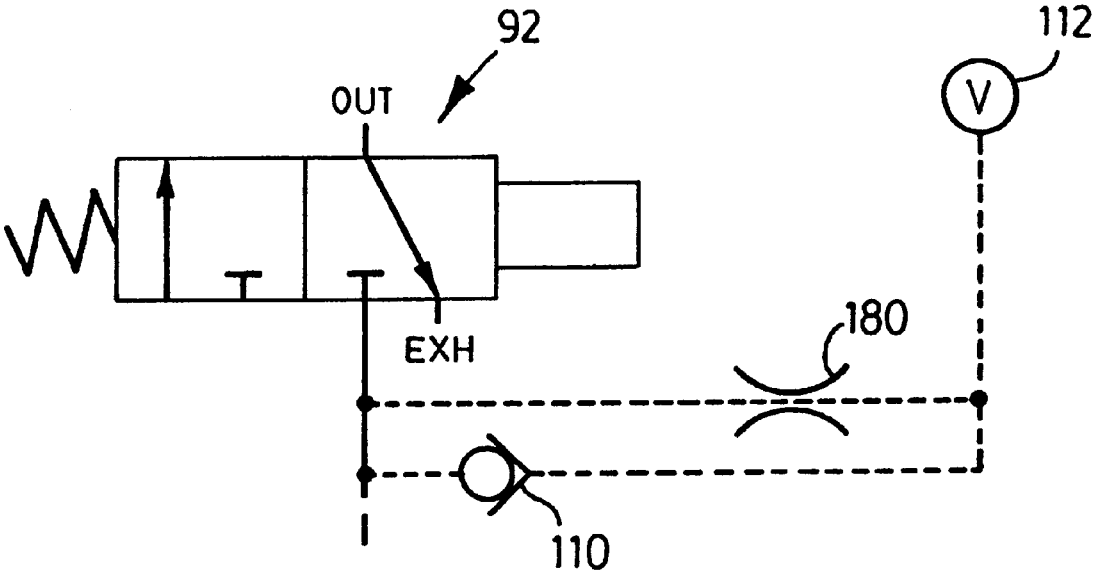
FIG. 6 is a schematic illustration similar to FIG. 5 but showing the operation of the pulse valve in its shifted position.

The operation of the preferred form of pulse valve 92 will now be described with reference to FIGS. 2 and 3 and the schematic illustrations comprising FIGS. 5 and 6. It will be understood that this pulse valve is a normally open, three way valve that closes shortly after being pressurized and remains closed until supply pressure is exhausted. The pulse of pressurized gas from this valve has a duration of less than 50 milliseconds with the preferred range for the duration of the pulse being between 5 and 15 milliseconds. In one particular preferred embodiment of a gun employing a pulse valve, the duration of the pulse pressurized gas is about 8 milliseconds. The duration of the pulse in a pulse valve can vary upon several different factors as explained hereinafter. In the unshifted position of the pulse valve which is shown in FIGS. 2 and 5, the supply of pressurized gas provided by the switch valve enters through the end passageway 98 and, as illustrated, this gas is able to pass out through the outlet 116 through an air gap (not shown) formed between end chamber 160 and the outlet 116. FIGS. 5 and 6 illustrate the use of a restricted orifice 180 in the pulse valve. This restricted orifice is arranged in parallel with the check valve 110 and is provided in the side of the piston member 105 at the location indicated in FIG. 3. The orifice 180 permits a restricted amount of air to flow during the unshifted phase from the passageway 98 and the passageway 114 into the valve chamber 104 which, as illustrated in FIG. 2, has a fixed volume. Within approximately 8 milliseconds there is a pressure build up in the chamber 104 which overcomes the biasing force of the spring and moves the piston member to the shifted position shown in FIG. 3. It will thus be seen that the duration of the pulse created by the valve is determined by the fixed volume of the chamber 104 in the unshifted position of the valve and the size of the orifice 180.

The end port at 170 can be closed off and sealed by means of a suitable screw or plug 172 threaded into the port. As illustrated in FIG. 6, in the shifted position of the valve, the pressurized gas in the line 150 and the hammer chamber are exhausted to atmosphere so as to permit the quick return of the hammer and bolt to the retracted position. At the same time, the flow of pressurized gas from the gas supply to the outlet 116 is cut off by means of the inlet end of the piston member 105 and the O-ring seal 118.

It will be seen from the above description that this gun 10 is provided with first and second pressurized gas delivery systems, both of which include the regulator 130. The first gas delivery system provides pressurized gas from the source to the barrel 40 for propelling the ball therefrom and this system includes the gas releasing valve or first valve 26 and can include the gas line 22 connected to the regulator. The second pressurized gas delivery system provides a pulse of pressurized gas from the same source to the chamber that houses the hammer in order to drive the hammer to the firing position. This second system includes a switch device or a switch valve 90 and the above described pulse valve 92. This second pressurized gas delivery system could also be described as a pneumatic circuit for operating the hammer.

With respect to the spring 48 that biases both the hammer and the bolt to their rearward positions, it will be appreciated by those skilled in the art that it is also possible to arrange a spring in the hammer chamber so that it engages the hammer instead of the bolt. Because the hammer and bolt are returned or retracted by means of a spring, this gun has the advantage of less recoil as there is no blow back to return the hammer to the retracted position.

Instead of using pressurized gas lines in the handle and body of the gun as illustrated in FIG. 4, it will be appreciated by those skilled in the gun art that internal gas passageways can readily be formed in the body of the gun and in the grip 14 to allow the passage of pressurized gas between the required components. For example, passageways drilled in connecting blocks or mounting blocks can form all or part of the required gas passageways.

The pressure of the gas provided to the pulse valve through its inlet can vary but in general it ranges between 80 and 150 psi, which generally is sufficient pressure to move the metal hammer to its forward firing position.

It will be appreciated by those skilled in this art that various modifications and changes can be made to the described paintball gun without departing from the spirit and scope of this invention. Accordingly, all such modifications and changes that fall within the scope of this invention are intended to be part thereof.

I claim:

1. A gas operated gun operable to shoot projectiles, said gun comprising:

a gun body including a gun handle;

a barrel mounted on said gun body;

a movable trigger mounted on the gun body;

a breech connected to a rear end of said barrel;

a bolt movable in said breech between a rearward position where a projectile can enter said breech through an inlet and a forward firing position;

a hammer connected to said bolt and mounted for sliding movement in a chamber formed in said gun body between a rearward position and a firing position;

a spring mounted in said gun and biasing both said bolt and said hammer towards said rearward positions;

a pneumatic circuit in said gun for operating said hammer, said circuit including a pulse valve, a trigger-activated switch mechanism for operating said pulse valve, and a gas regulator for supplying gas at a predetermined pressure to said pulse valve, said pulse valve having a valve outlet for a pulse of pressurized gas which can be produced by said pulse valve when said trigger is pulled, said valve outlet being connected by a passage to said chamber; and a further valve mounted in said gun body and adapted to be opened by engagement by said hammer, when said hammer moves to said firing position, to permit passage of pressurized gas from a pressurized gas source into said barrel to propel said projectile along and out of said barrel, wherein, when said trigger is pulled to shoot a projectile, said pulse of gas is delivered to said chamber and acts to drive said hammer to said firing position and thereby cause said further valve to release pressurized gas and shoot the projectile.

2. A gas operated gun according to claim 1 wherein said spring is a coil spring mounted in said breech and engaging said bolt.

3. A gas operated gun according to claim 1 wherein said switch mechanism is a two-position switch valve mounted in said gun body adjacent said trigger, an outlet of said gas regulator is connected by a gas line to an inlet of said switch valve, and an outlet of said switch valve is connected by a further gas line to an inlet of said pulse valve.

4. A gas operated gun according to claim 1 wherein an outlet of said gas regulator is connected by a pressurized gas line to said further valve and said regulator is adapted to provide relatively high pressure gas from said pressurized gas source to said further valve.

5. A gas operated gun according to claim 1 wherein said pulse valve is a normally open, three way valve that closes shortly after being pressurized and remains closed until supply pressure is exhausted.

6. A gas operated gun according to claim 5 wherein said pulse of pressurized gas provided by said pulse valve has a duration of less than 50 milliseconds.

7. A gas operated gun according to claim 5 wherein said pulse of pressurized gas has a duration of between 5 and 15 milliseconds.

8. A gas operated gun according to claim 7 wherein said pulse valve has an exhaust hole that vents to atmosphere.

9. A gas operated gun according to claim 7 wherein said gun is operable to fire paintballs and said breech and barrel are internally sized respectively to receive and shoot a paintball.

10. A gas operated gun according to claim 7 wherein said pulse valve includes a valve body containing a valve chamber and having an inlet and said valve outlet, a piston member slidable back and forth in said valve chamber, and a valve spring biasing said piston member towards an end of said valve chamber, and wherein a small orifice is arranged in a side of said piston member.

11. A paintball gun comprising:

a gun body and a barrel mounted on said gun body;

a trigger movably mounted on said gun body;

a hammer slidably mounted in a chamber formed in said gun body and movable between a retracted position and a forward position;

a first pressurized gas circuit for delivering pressurized propellant gas from a supply to said barrel for propelling paintballs therefrom, the first pressurized gas circuit including a first valve; and a second pressurized gas circuit connectible to a gas supply to receive gas therefrom, said second pressurized gas circuit including a pulse valve having a gas inlet and a gas outlet, a trigger-activated switch valve capable of operating said pulse valve and having a valve outlet operably connected to said gas inlet of the pulse valve, said pulse valve being adapted to provide a pulse of pressurized propellant gas at said gas outlet when said trigger is pulled, said gas outlet being operably connected to said chamber, wherein, during use of said gun, said pulse of propellant gas is capable of driving said hammer to its forward position at which it strikes said first valve to open it and release pressurized propellant gas into said barrel in order to propel a paintball therefrom.

12. A paintball gun according to claim 11 including a bolt slidably mounted in a breech of said gun from a retracted position where a paintball can enter said breech to a forward firing position and wherein said hammer is connected to said bolt for movement therewith.

13. A paintball gun according to claim 12 wherein said second circuit includes a gas regulator mounted on said gun body and having a regulator outlet connected by a gas line to an inlet of said switch valve.

14. A paintball gun according to claim 12 including a return spring engaging said bolt and biasing the bolt and said hammer to the retracted position.

15. A paintball gun according to claim 14 wherein said return spring is a coil spring extending around said bolt, said coil spring engaging a rear end section of said bolt.

16. A paintball gun according to claim 13 wherein said regulator has a second regulator outlet connected by a pressurized gas line to said first valve and said regulator is adapted to provide relatively high pressure gas from said supply to said first valve.

17. A paintball gun according to claim 11 wherein said pulse valve is a normally open, three way valve that closes shortly after being pressurized and remains closed until supply pressure is exhausted.

18. A paintball gun according to claim 17 including a bolt slidably mounted in a breech forming part of said gun body and slidable from a retracted position for loading a paintball to a forward firing position.

19. A paintball gun according to claim 18 wherein said second circuit includes a gas regulator mounted on said gun body and having first and second regulator outlets and an inlet connectible to said supply of propellant gas, said first regulator outlet being operably connected to an inlet of said switch valve and said second regulator outlet being operably connected to said first valve.

20. In a gas-powered gun for firing balls, the gun adapted to be connected to a source of pressurized gas and having trigger-activated valving for controlling the flow of pressurized gas within the gun, a barrel, a breech at a rear end of the barrel for receiving one ball at a time through a ball feed port, a hammer slidably mounted in a chamber formed in said gun and biased to a retracted, non-firing position, and a bolt slidable within the breech to advance said one ball to a firing position and close off said feed port, the improvement comprising:

a first pressurized gas delivery system for providing pressurized gas from said source to said barrel for propelling said ball therefrom, said first pressurized gas delivery system including a gas releasing valve which is opened by said hammer being driven to a firing position; and a second pressurized gas delivery system for providing a pulse of pressurized gas from said source to said chamber in order to drive said hammer to said firing position, said second pressurized gas system including a pulse valve which is operated by said trigger-activated valving.

* * * * *